US009343285B2

(12) United States Patent
Green et al.

(10) Patent No.: US 9,343,285 B2
(45) Date of Patent: May 17, 2016

(54) ANNULAR ION GUIDE

(71) Applicant: Micromass UK Limited, Wilmslow (GB)

(72) Inventors: Martin Raymond Green, Bowdon (GB); David J. Landridge, Stockport (GB)

(73) Assignee: Micromass UK Limited, Wilmslow (GB)

( * ) Notice: Subject to any disclaimer, the term of this patent is extended or adjusted under 35 U.S.C. 154(b) by 0 days.

(21) Appl. No.: 14/349,724

(22) PCT Filed: Oct. 1, 2012

(86) PCT No.: PCT/GB2012/052420

§ 371 (c)(1),
(2) Date: Apr. 4, 2014

(87) PCT Pub. No.: WO2013/050747

PCT Pub. Date: Apr. 11, 2013

(65) Prior Publication Data

US 2015/0048246 A1 Feb. 19, 2015

(30) Foreign Application Priority Data

Oct. 5, 2011 (GB) ..... 1117158.4

(51) Int. Cl.

| | |
|---|---|
| ***H01J 49/42*** | (2006.01) |
| ***H01J 49/06*** | (2006.01) |
| ***H01J 49/36*** | (2006.01) |

(52) U.S. Cl.

CPC ..... *H01J 49/424* (2013.01); *H01J 49/065* (2013.01); *H01J 49/066* (2013.01); *H01J 49/36* (2013.01)

(58) Field of Classification Search

USPC ..... 250/283, 287, 297, 288, 292, 286, 282

See application file for complete search history.

(56) References Cited

U.S. PATENT DOCUMENTS

| | | | | |
|---|---|---|---|---|
| 7,807,963 | B1 * | 10/2010 | Bier | H01J 49/422 250/281 |
| 2002/0148959 | A1 | 10/2002 | Weiss et al. | |
| 2003/0132379 | A1 * | 7/2003 | Li | 250/286 |
| 2007/0246650 | A1 | 10/2007 | Lee et al. | |
| 2008/0048113 | A1 * | 2/2008 | Franzen | H01J 49/4225 250/292 |
| 2008/0203293 | A1 * | 8/2008 | Makarov | H01J 49/0009 250/283 |
| 2009/0001265 | A1 | 1/2009 | Baba et al. | |
| 2009/0078866 | A1 | 3/2009 | Li et al. | |
| 2009/0179150 | A1 | 7/2009 | Kovtoun et al. | |

FOREIGN PATENT DOCUMENTS

| | | |
|---|---|---|
| CN | 101369510 | 2/2009 |
| EP | 1367633 | 12/2003 |
| GB | 2415289 | 12/2005 |
| GB | 2441198 | 2/2008 |
| GB | 2486584 | 6/2012 |
| GB | 2489310 | 9/2012 |
| JP | 09213498 | 8/1997 |
| WO | 2007/000587 | 1/2007 |

* cited by examiner

*Primary Examiner* — Phillip A Johnston
*Assistant Examiner* — Hsien Tsai
(74) *Attorney, Agent, or Firm* — Diederiks & Whitelaw, PLC

(57) ABSTRACT

An annular ion guide is disclosed comprising inner and outer electrodes. Ions are confined within an annular ion guiding region by RF or pseudo-potential barriers in both an outward and inward radial direction.

39 Claims, 6 Drawing Sheets

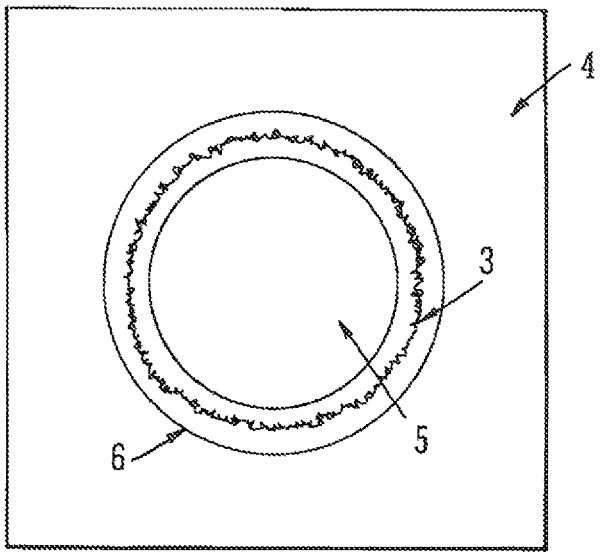
FIG. 2
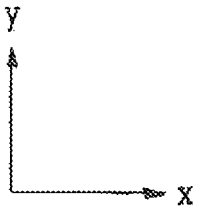

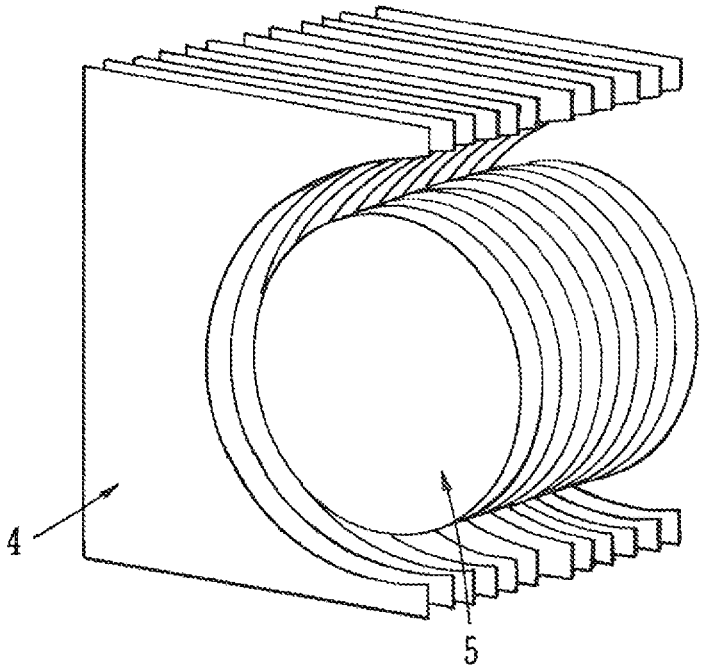
FIG. 3
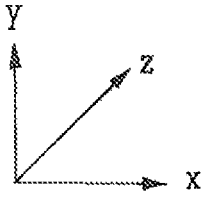

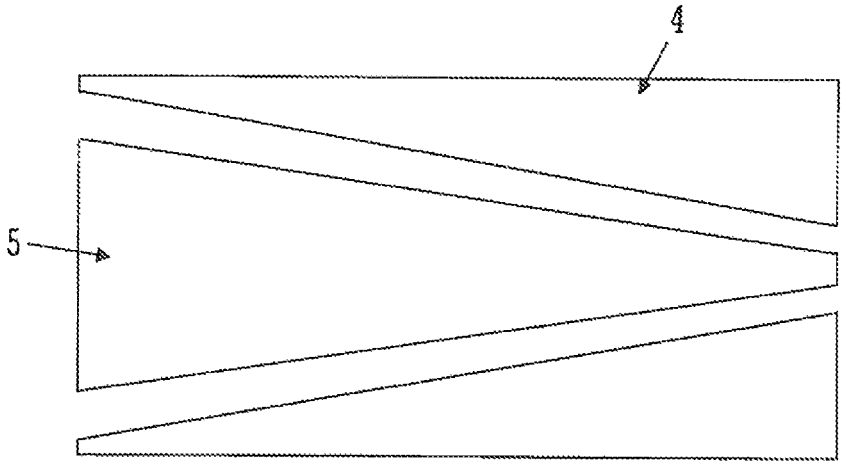
FIG. 5
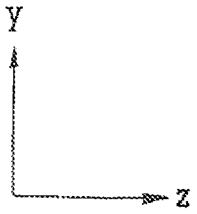

ANNULAR ION GUIDE

CROSS REFERENCE TO RELATED APPLICATIONS

This application is the National Stage of International Application No. PCT/GB2012/052420, filed 1 Oct. 2012, which claims priority from and the benefit of U.S. Provisional Patent Application Ser. No. 61/547,210 filed 14 Oct. 2011 and United Kingdom Patent Application No. 1117158.4 filed on 5 Oct. 2011. The entire contents of these applications are incorporated herein by reference.

BACKGROUND OF THE PRESENT INVENTION

The present invention relates to an ion guide or ion trap, a mass spectrometer, a method of guiding ions and a method of mass spectrometry.

Stacked ring ion guides are well known and comprise a plurality of ring electrodes each having an aperture through which ions are transmitted. The ion confining region of conventional stacked ring ion guides is circular in cross section.

It is known to increase the capacity of a conventional stacked ring ion guide by increasing the radius of the aperture to allow ions to occupy a larger volume. However, it becomes progressively harder to apply a transient DC or travelling DC voltage wave to such a device in order to urge ions along the length of the on guide due to the fact that the electric field relaxes within the ion guide. The relaxation of the electric field weakens the electric field experienced by ions towards the centre of the ion confining region for a fixed applied transient DC voltage. A higher transient DC voltage is therefore required in order to propel ions through the device. However, this can become problematic.

If it is required to apply a linear or non linear DC electric field over the axial length of the ion guide, then electric field penetration or relaxation at the entrance and exit of the device can cause significant disruption of the electric field.

Stacked ring ion guides are also known which have elliptical or rectangular apertures. Such ion guides effectively stretch the ion guide region in one radial direction without increasing the size of the aperture in the other radial direction. However, such ion guides suffer from the problem that electric field effects at the extremes of the device in the radial direction of elongation prevent ions from occupying the entire internal volume.

Cylindrical Field Asymmetric Ion Mobility Spectrometry ("FAIMS") devices are also known and are conventionally operated at atmospheric pressure. A FAIMS device may comprise an inner cylindrical electrode and an outer cylindrical electrode. An asymmetric DC voltage waveform is applied between the inner and outer electrodes at atmospheric pressure resulting in some focussing for ions which have a specific difference in ion mobility in a high electric field compared to a low electric field. It will be understood by those skilled in the art that ions are not confined radially within the FAIMS device in either radial direction by a RF or pseudo-potential barrier.

The limited space charge capacity of conventional ion traps and ion guides can result ire loss of transmission or sensitivity due to inefficient ion confinement which leads to ion losses. Furthermore, conventional ion traps and ion guides may suffer from loss of analytical performance when used as an ion mobility separator ("IMS") or mass to charge ratio separator. This is characterised by loss of resolution or separation power and/or by unexpected shifts in on ejection times. These shifts lead to inaccuracy of analytical measurements.

It is therefore desired to provide an improved ion guide.

SUMMARY OF THE INVENTION

According to an aspect of the present invention there is provided an ion guide or ion trap comprising:

a first group of inner electrodes;

a second group of outer electrodes;

an annular ion guiding region arranged between the first and second groups of electrodes; and a RF voltage device arranged and adapted to apply a RF voltage to the first and second groups of electrodes so that ions are confined within the annular ion, guiding region by a first radial RF or pseudo-potential barrier and by a second different radial RF or pseudo-potential barrier.

The first radial RF or pseudo-potential barrier preferably acts to prevent ions moving in a radially inward direction towards the inner electrodes.

The second radial RF or pseudo-potential barrier preferably acts to prevent ions moving in a radially outward direction towards the outer electrodes.

According to an embodiment:

(a) ions within the annular ion guiding region are preferably free to rotate or orbit around the full circumference of the annular ion guiding region; and/or (b) ions are preferably substantially unconfined or unrestrained in a tangential direction which is orthogonal both to a radial direction and to the longitudinal axis of the ion guide or ion trap; and/or (c) ions are preferably unconfined or unrestrained by DC potentials and/or RF pseudo-potentials in a tangential direction which is orthogonal both to a radial direction and to the longitudinal axis of the ion guide or ion trap; and/or (d) ions are preferably substantially free to occupy the entire annular area of the annular ion guiding region.

In a mode of operation the RF voltage device is preferably arranged and adapted to apply different or opposite phases of the RF voltage to inner and outer electrodes which are arranged: (i) at substantially the same axial displacement; and/or (ii) in substantially the same plane; and/or (iii) substantially opposite each other in a radial direction.

In a mode of operation the RF voltage device is preferably arranged and adapted to apply the same phase of the RF voltage to inner and outer electrodes which are arranged either (i) at substantially the same axial displacement; and/or (ii) in substantially the same plane; and/or (iii) substantially opposite each other in a radial direction.

The RF voltage device is preferably arranged and adapted to apply different or opposite phases of the RF voltage to alternate or axially adjacent inner and/or outer electrodes or after/late or axially adjacent sub-groupings of inner and/or outer electrodes.

The sub-groupings of the inner and/or outer electrodes preferably comprise at least 2, 3, 4, 5, 6, 7, 8, 9 or 10 electrodes.

Electrodes in each sub-grouping of electrodes are preferably maintained at substantially the same DC potential and/or at substantially the same phase of the RF voltage.

According to an embodiment:

(a) the RF voltage has a frequency selected from the group consisting of (i) <100 kHz; (ii) 100-200 kHz; (iii) 200-300 kHz; (iv) 300-400 kHz; (v) 400-500 kHz; (vi) 0.5-1.0 MHz (vii) 1.0-1.5 MHz; (viii) 1.5-2.0 MHz; (ix) 2.0-2.5 MHz; 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix)

7.0-7.5 MHz; (xx) 7.5-8.0 MHz (xxi) 8.0-8.5 MHz; (xxii) 8.5-9.0 MHz; (xxiii) 9.0-9.5 MHz; (xxiv) 9.5-10.0 MHz; and (xxv) >10.0 MHz; and/or (b) the amplitude of the RF voltage is selected from the group consisting of (i) <50 V peak to peak; (ii) 50-100 V peak to peak; (iii) 100-150 V peak to peak; (iv) 150-200 V peak to peak; (v) 200-300 V peak to peak; (vi) 300-400 V peak to peak; (vii) 400-500 V peak to peak; (viii) 500-600 V peak to peak; (ix) 600-700 V peak to peak; (x) 700-800 V peak to peak; (xi) 800-900 V peak to peak; (xii) 900-1000 V peak to peak; (xiii) 1000-1100 V peak to peak; (xiv) 1100-1200 V peak to peak; (xv) 1200-1300 V peak to peak; (xvi) 1300-1400 V peak to peak; (xvii) 1400-1500 V peak to peak; and (xviii) >1500 V peak to peak.

According to an embodiment:

(i) inner and outer electrodes arranged at substantially the same axial displacement are maintained at substantially the same DC potential; and/or (ii) positive and/or negative ions within the annular ion guiding region are not substantially attracted in a radial direction to either the inner electrodes or to the outer electrodes.

The outer electrodes and/or the inner electrodes preferably comprise:

(i) one or more planar or sheet electrodes; and/or (ii) one or more axially segmented cylindrical arrangement of electrodes; and/or (iii) one or more axially segmented circular cylindrical arrangement of electrodes; and/or (iv) a stacked ring ion guide.

The outer electrodes preferably comprise one or more substantially circular, elliptical or polygonally shaped apertures.

The inner electrodes are preferably substantially circular, elliptical or polygonally shaped.

The outer electrodes and/or the inner electrodes preferably comprise one or more rod electrodes.

The one or more rod electrodes preferably have a substantially circular or hyperbolic cross-section.

According to an embodiment either:

(a) the second group of outer electrodes comprises a lesser or greater number of electrodes than the first group of inner electrodes; or (b) the second group of outer electrodes comprises the same number of electrodes as the first group of inner electrodes.

The cross-sectional area of the annular ion guiding region between the inner and outer electrodes is preferably selected from the group comprising: (i) 5-10 $mm^2$; (ii) 10-20 $mm^2$; (iii) 20-30 $mm^2$; (iv) 30-40 $mm^2$; (v) 30-40 $mm^2$; (vi) 40-50 $mm^2$; (vii) 50-60 $mm^2$; (viii) 60-70 $mm^2$; (ix) 70-80 $mm^2$; (x) 80-90 $mm^2$; (xi) 90-100 $mm^2$; and (xi) >100 $mm^2$.

The first group of inner electrodes are preferably substantially concentric with the second group of outer electrodes.

According to an embodiment either: (i) the first group of inner electrodes are arranged at substantially the same axial spacing as the second group of outer electrodes; or (ii) the first group of inner electrodes are arranged at a substantially different, greater or lesser axial spacing than the second group of outer electrodes.

According to an embodiment in a mode of operation the ion guide or ion trap is maintained at a pressure selected from the group consisting of: (i) $<1\times10^{-7}$ mbar; (ii) $1\times10^{-7}$ to $1\times10^{-6}$ mbar; (iii) $1\times10^{-6}$ to $1\times10^{-5}$ mbar; (iv) $1\times10^{-5}$ to $1\times10^{-4}$ mbar; (v) $1\times10^{-4}$ to $1\times10^{-3}$ mbar; (vi) 0.001-0.01 mbar; (vii) 0.01-0.1 mbar; (viii) 01-1 mbar; (ix) 1-10 mbar; (x) 10-100 mbar; (xi) 100-1000 mbar; or (xii) >1000 mbar.

The ion guide or ion trap preferably further comprises a device arranged and adapted to introduce a buffer gas into the annular ion guiding region in order to collisionally cool ions.

The ion guide or ion trap preferably further comprises a device arranged and adapted to apply an electrostatic driving force to at least some of the first group of inner electrodes and/or to at least some of the second group of outer electrodes in order to urge ions along at least a portion of the axial length of the ion guide or ion trap.

According to an embodiment, in use, an axial DC potential gradient is maintained along at least a portion of the axial length of the ion guide or ion trap.

The axial DC potential gradient preferably either: (i) is maintained substantially constant with time as ions pass along the ion guide or ion trap; or (ii) varies with time as ions pass along the ion guide or ion trap.

According to an embodiment in use one or more transient DC voltages or one or more transient DC voltage waveforms are applied to the first group of inner electrodes and/or to the second group of outer electrodes and/or to one or more additional electrodes so that ions are caused to move from one end of the ion guide or ion trap to another end of the ion guide or ion trap.

The on guide or ion trap preferably comprises a DC voltage device arranged and adapted to apply a DC voltage to the first group of electrodes and/or the to second group of electrodes and/or to one or more additional electrodes in order to maintain a quadratic or other potential well along at least a portion of the axial length of the ion guide or on trap.

The ion guide or ion trap preferably further comprises a device which is arranged and adapted to resonantly, parametrically or auto-resonantly eject ions or to eject ions due to mass selective instability in a radial and/or axial direction from the ion guide or ion trap.

Ions are preferably mass selectively or mass to charge ratio selectively ejected from the ion guide or ion trap in a radial and/or axial direction from the ion guide or ion trap.

Ions are preferably mass or mass to charge ratio selectively ejected from the on guide or ion trap in order of their mass to charge ratio or in reverse order of their mass to charge ratio.

Ions are preferably caused to separate according to their ion mobility or mass or mass to charge ratio along the axial length of the ion guide or ion trap.

The annular ion guiding region preferably either: (i) varies in size and/or shape along the length of the ion guide or ion trap; or (ii) has a width and/or height and/or diameter and/or cross-sectional area which varies, increases or decreases along the longitudinal length of the ion guide or ion trap.

The ion guide or ion trap preferably comprises a linear, non-linear, curved, open-loop or closed-loop ion guide or ion trap.

The ion guide or ion trap preferably further comprises an entrance electrode arranged upstream of the ion guide or ion trap and/or an exit electrode arranged downstream of the ion guide.

According to an embodiment one or more DC and/or AC or RF voltages are applied to the entrance electrode and/or the exit electrode in order to confine ions axially within the ion guide or ion trap.

According to an aspect of the present invention there is provided a mass spectrometer comprising an ion guide or ion trap as described above.

According to an aspect of the present invention there is provided a method of guiding ions comprising:

providing a first group of inner electrodes, a second group of outer electrodes and an annular ion guiding region arranged between the first and second groups of electrodes; and applying a RF voltage to the first and second groups of electrodes so that ions are confined within the annular ion guiding region by a first radial RF or pseudo-potential barrier and by a second different radial RF or pseudo-potential barrier.

According to an aspect of the present invention there is provided a method of mass spectrometry comprising a method of guiding ions as described above.

The preferred embodiment relates to an ion guide or ion trap having a significantly improved ion capacity compared to conventional ion guides without significantly affecting the ability to apply an DC electric field to the ion guide or on trap in order to urge or propel ions along the length of the on guide or ion trap in an axial direction.

A conventional stacked ring ion guide may be considered having an inner diameter R and may be contrasted with a coaxial cylindrical ion guide or ion trap according to an embodiment of the present invention. The ion guide or ion trap according to an embodiment of the present invention may be such that the gap between the two cylindrical arrangements of electrodes is 2R and the radius of the inner cylindrical arrangement is 5R. Both ion guides may be considered as having an axial length L.

The total confining volume A_SRIG of the conventional stacked ring ion guide having a circular ion guiding region is given by:

$$A_SRIG=\pi\cdot R^2\cdot L \quad (1)$$

In contrast, the total confining volume A_CIG of the coaxial on guide according to an embodiment of the present invention which has an annular ion guiding region is given by $$A_CIG=49\pi\cdot R^2\cdot L-25\pi\cdot R^2\cdot L=24\pi\cdot R^2\cdot L \quad (2)$$

It is apparent, therefore, that the ion capacity of a preferred coaxial ion guide or ion trap having an annular ion guiding region may be, for example, 24 times that of a conventional ion tunnel ion guide without significantly affecting the amplitude of an applied transient DC voltage which is required in order to propel ions axially along the length of the ion guide or ion trap.

A particular advantage of the preferred embodiment is that ions can occupy the entire annular volume resulting in the highest capacity possible, in particular, ions are free to occupy the entire annular area over all or part of the axial length of the ion guide or ion trap resulting in a single device with high capacity.

The preferred embodiment is able to confine ions at reduced pressure in a mass to charge ratio dependent pseudo-potential well or by a combination of a DC and a pseudo-potential well.

An ion guide or ion trap according to a preferred embodiment has a broad mass to charge ratio dependent transmission characteristic which is independent of differential ion mobility.

According to an embodiment there is provided an ion guide or ion trap comprising two concentric or eccentric substantially cylindrical elements wherein an inhomogeneous electric field oscillating at RF frequency confines ions within an annular volume forming a mass to charge ratio dependent pseudo potential confining field. The cylinders are preferably circular cylinders and the device preferably comprises a stacked ring ion guide construction.

According to an embodiment a buffer gas is introduced into the annular volume to collisionally cool ions.

The ion guide or ion trap may be used to perform separation of ions dependent on the mobility of the ions.

The ion guide or ion trap may be used to perform separation of ions dependent on the mass to charge ratio of the ions.

The preferred device may be used as a high capacity ion trap preferably with axial mass selective ion ejection.

The present invention relates to an ion guide or ion trap. The preferred ion trap comprises two concentric or eccentric cylinders in which ions are confined within a pseudo-potential confining field.

According to an embodiment there is provided a high capacity ion guide or ion trap in which ions are confined within the enclosed volume between two concentric or eccentric substantially cylindrical elements by application of an inhomogeneous electric field oscillating at RF frequency within the annular volume forming a mass to charge ratio dependent pseudo potential confining field.

According to an embodiment the cylinders are circular cylinders.

According to an embodiment the preferred device comprises a stacked ring ion guide.

According to an embodiment an electrostatic driving force may be applied to the electrodes comprising the ion guide or ion trap in order urge ions along the length of the device.

The present invention results in an ion guide or ion trap having an increased charge capacity thereby allowing larger populations of ions to be handled without degrading performance. This increases the dynamic range of the preferred ion guide or ion trap.

The present invention provides a high charge capacity ion guide or ion trap and therefore allows the transport or separation of large populations of ions with less distortion due to space charge interaction than conventional ion guides.

The preferred device preferably provides a high charge capacity ion guide or ion trap in a compact form.

The preferred device preferably allows easy application of DC fields for ion transport, ion confinement or mass or mobility separation.

According to an embodiment the mass spectrometer may further comprise:

(a) an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") on source; (iv) a Matrix Assisted Laser Desorption Ionisation ("MALDI") ion source; (v) a Laser Desorption Ionisation ("LDI") ion source; (vi) an Atmospheric Pressure Ionisation ("API") on source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") on source; (xx) a Glow Discharge ("GD") on source; and (xxi) an Impactor ion source; and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("ED") fragmentation device; and/or (g) a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser, (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic or orbitrap mass analyser; (x) a Fourier Transform electrostatic or orbitrap mass analyser; (xi) a Fourier Transform mass analyser; (xii) a Time of Flight mass, analyser; (xiii) an orthogonal acceleration Time of Flight mass analyser; and (xiv) a linear acceleration Time of Flight mass analyser; and/or (h) one or more energy analysers or electrostatic energy analysers; and/or (i) one or more ion detectors; and/or (j) one or more mass filters selected from the group consisting of: (i) a quadrupole mass filter; (ii) a 2D or linear quadrupole on trap; (iii) a Paul or 3D quadrupole ion trap; (iv) a Penning ion trap; (v) an ion trap; (vi) a magnetic sector mass filter; (vii) a Time of Right mass filter; and (viii) a Wein filter; and/or (k) a device or ion gate for pulsing ions; and/or (l) a device for converting a substantially continuous ion beam into a pulsed ion beam.

The mass spectrometer may further comprise either:

(i) a C-trap and an Orbitrap® mass analyser comprising an outer barrel-like electrode and a coaxial inner spindle-like electrode, wherein in a first mode of operation ions are transmitted to the C-trap and are then injected into the Orbitrap® mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the Orbitrap® mass analyser; and/or (ii) a stacked ring ion guide comprising a plurality of electrodes each having an aperture through which ions are transmitted in use and wherein the spacing of the electrodes increases along the length of the on path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

BRIEF DESCRIPTION OF THE DRAWINGS

Various embodiments of the present invention together with other arrangements given for illustrative purposes only will now be described, by way of example only, and with reference to the accompanying drawings in which:

FIG. 2 shows an annular ion guide according to an embodiment of the present invention;

FIG. 3 shows an annular ion guide according to an embodiment of the present invention;

FIG. 5 shows an embodiment wherein the annular ion guiding region tapers towards the exit of the ion guide.

DETAILED DESCRIPTION OF PREFERRED EMBODIMENTS

A conventional stacked ring on guide will first be described.

Figure 1A:
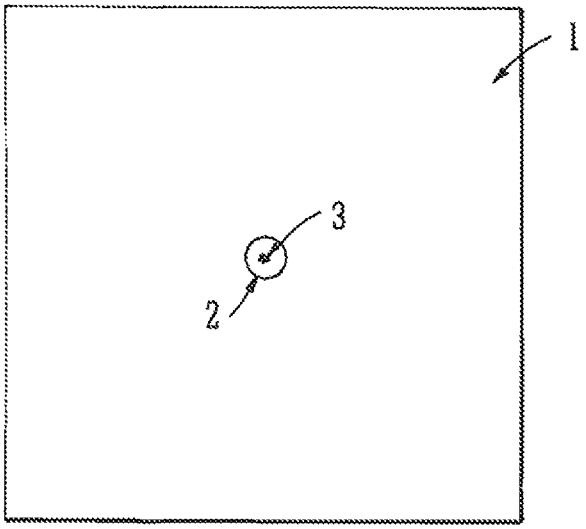
FIG. 1A PRIOR ART
FIG. 1A shows a conventional stacked ring ion guide having a circular aperture and FIG. 1B shows a known ion guide comprising a plurality of plate electrodes each having an elongated aperture.

FIG. 1A shows an electrode 1 of a conventional stacked ring ion guide in the (x, y) plane. Each electrode 1 has a circular hole or aperture 2 which defines an ion trapping region in the radial (x, y) direction. An ion cloud 3 may be confined within this region and will extend the axial (z) direction. The conventional stacked ring ion guide comprises a series of electrodes 1 wherein axially adjacent electrodes are supplied with opposite phases of an RF voltage.

Figure 1B:
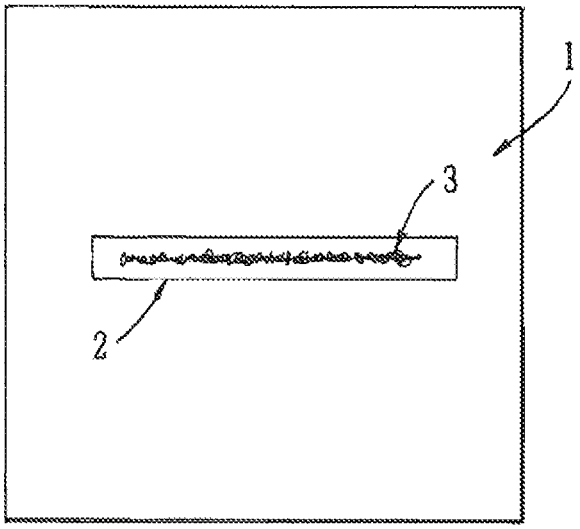
FIG. 1B PRIOR ART

FIG. 1B shows another known stacked ring on guide in the (x, y) plane. According to this arrangement the opening or aperture 2 in each plate electrode 1 is elongated in one axis. Ions 3 may take up positions as shown in the (x, y) plane. It is apparent that the volume occupied by ions in the arrangement shown in FIG. 1B is greater than the volume occupied by ions in the arrangement shown in FIG. 1A.

However, as shown in FIG. 1B, ions cannot occupy the entire region bounded by the opening 2 in the plate electrode 1 as they are repelled by the confining potential applied to the ion guide.

FIG. 2 shows a preferred embodiment of the present invention in the (x, y) plane and shows an arrangement comprising an outer electrode 4 with a large circular aperture 6 and an inner circular electrode 5 disposed within the circular aperture 6. An annular ion guiding region or volume is provided between the outer electrode 4 and the inner electrode 5. Ions 3 are free to occupy the ion guiding region and it is apparent that the ion guiding region according to the preferred embodiment is larger than on guiding regions of corresponding conventional ion guides as shown in either FIG. 1A or 1B.

FIG. 3 shows a three dimensional representation of a coaxial stacked ring ion guide according to the preferred embodiment. The inner electrodes 5 are preferably concentric with the outer electrodes 4 and define an annular ion guiding region or volume in which ions may be confined.

Figure 4:
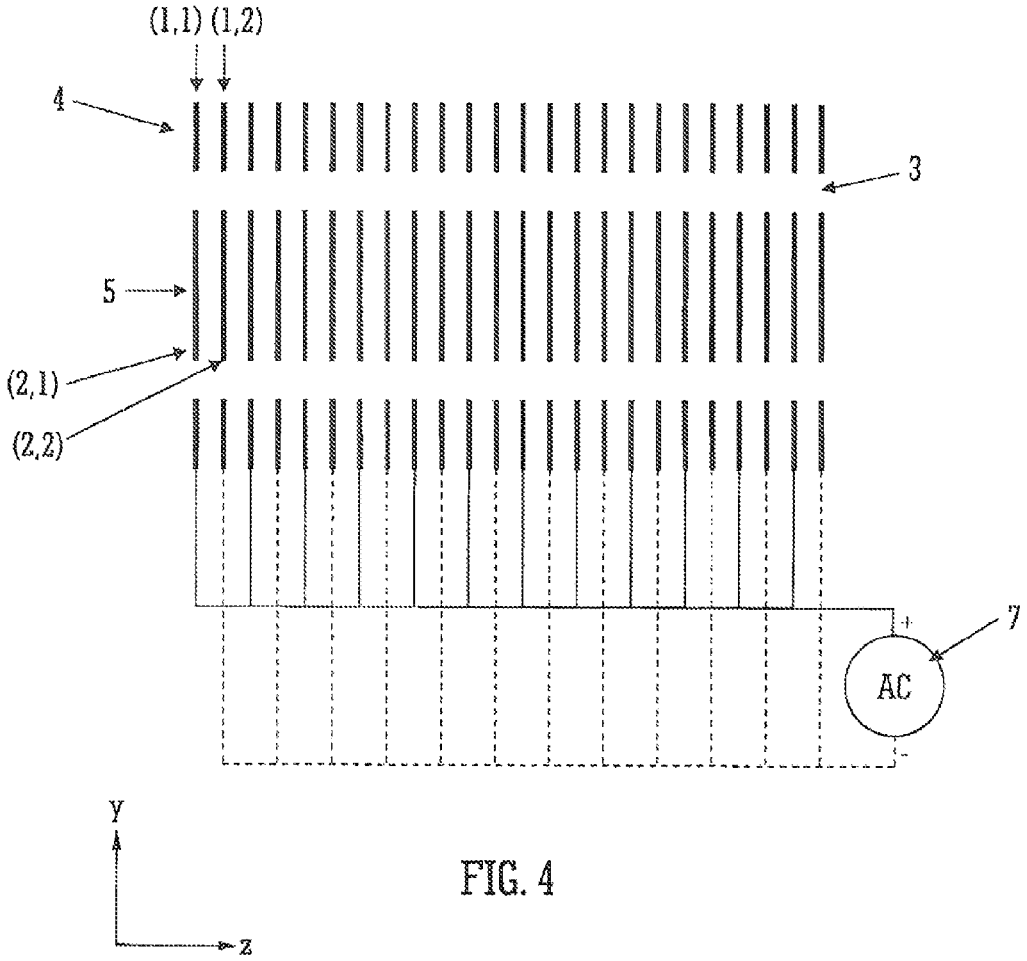
FIG. 4 shows a side view of an annular ion guide according to an embodiment of the present invention.

FIG. 4 shows the preferred ion guide or ion trap in the (y, z) direction. An AC or RF voltage supply 7 is shown which preferably supplies opposite phases of an RF voltage to adjacent electrodes of the inner 5 and outer 4 electrode arrangements. The inner electrodes may be denoted as (2,n) wherein n is the number of the electrode from the entrance and similarly the outer electrodes may be denoted as (1,n).

According to the preferred embodiment plate electrode (2,1) is directly opposite plate electrode (1,1). According to the preferred embodiment plate electrodes which are arranged directly opposite each other such as plate electrodes (1,1) and (2,1) are maintained at opposite phases of the applied RF voltage. As a result a radially confining pseudo-potential field is generated which serves to confine ions within the annular ion guiding region or volume 3.

The preferred ion guide or ion trap may be filled with buffer gas so that ions may be collisionally cooled to near thermal temperatures. According to an embodiment the preferred ion guide or ion trap may be maintained at a pressure in the range $10^{-4}$ to 100 mbar.

Ions may be driven along the axial length of the ion guide or ion trap (i.e. in the axial or z direction) by applying a travelling wave or transient DC voltage waveform to the electrodes or by applying a static DC electric field.

Embodiments are contemplated wherein ions may be driven to specific regions or areas of the ion guide in the x and/or y directions by applying a DC electric field in the x or y direction.

A DC potential may also be applied to a separate electrode structure (not shown) which may be arranged outside or inside the ion trapping volume which results in penetration of a DC field within the preferred ion guide or ion trap.

Ions may be trapped or axially confined by application of two or more DC or pseudo-potential barriers arranged at different points along the axial (z) axis of the preferred ion guide or ion trap.

The device may be used as a mobility separator. Ions may be pulsed into the preferred ion guide or ion trap and then driven axially along and/or through the preferred ion guide or ion trap by applying a travelling DC voltage wave or a static DC electric field to the electrodes.

Mass selective ejection may be accomplished by resonant or auto resonant excitation.

One or more quadratic or non quadratic DC wells may be superimposed along the axial length of the ion guide or ion trap so that one or more potential minima are created along the length of the ion guide or ion trap. Ions will take up positions at the bottom of the axial potential well in a ring or toroid in the x, y direction.

A dipolar or quadrupolar (parametric) excitation potential may be applied to the electrodes or may be swept so as to cause ions having particular mass to charge ratios to gain energy and increase in amplitude of oscillation in the axial (z) direction. These ions may then be ejected at both ends or at one end of the device depending on the symmetry of the axial potential well.

The preferred device may be used as a Collision Induced Dissociation ("CID") cell, an Electron Transfer Dissociation ("ETD") cell or a photo fragmentation cell.

Further embodiments are also contemplated. According to an embodiment the gap between the inner electrodes 5 and the outer electrodes 4 may vary continuously or discontinuously in either the radial x, y directions and/or the axial z direction.

The effective radius of the annular ion volume may also vary along the axial length of the ion guide or ion trap in the axial (z) direction. FIG. 5 shows an embodiment of the present invention wherein the radius of the annular volume gradually reduces from the entrance region of the on guide or ion trap to the exit region of the ion guide or ion trap.

The preferred ion guide or ion trap may comprise a tapered or conical geometry and may be arranged so as to allow on populations to be compressed from residing in a relatively large annular ion guiding region or volume to reside in a relatively small ion guiding region or volume. The preferred ion guide or ion trap may be arranged so as to facilitate being interfaced with a non concentric ion guide.

The longitudinal axis of the device may be curved or non linear. For example, ions may be caused to turn through 90° or 180° in either the x and/or y directions over the length of the device in the axial (z) direction.

The preferred ion guide or ion trap may be arranged so as to form a closed loop ion guide or ion trap with the entrance and exit ends joined to form a contiguous annular ion volume.

The preferred ion guide or ion trap may be joined or coupled to other ion guides to allow or enable ion populations to be transferred between different ion guides or ion traps.

Figure 6A:
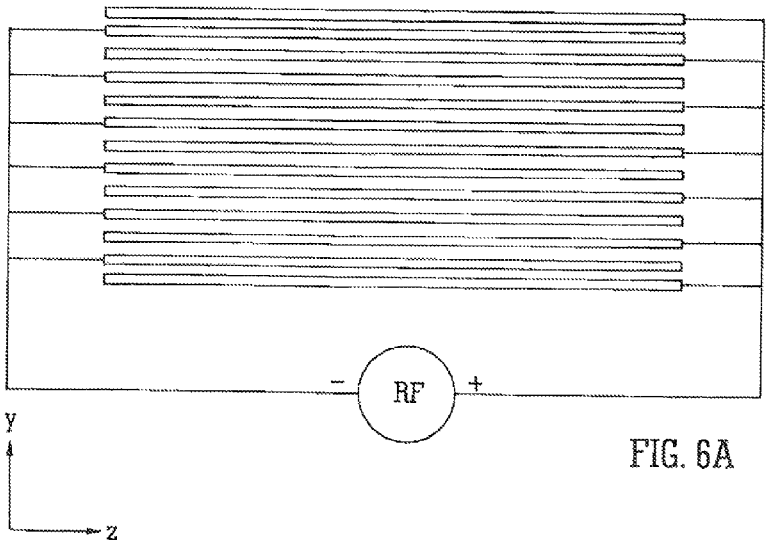
FIG. 6A shows a side view of a further embodiment wherein the ion guide or ion trap comprises an inner arrangement of rod electrodes and an outer arrangement of rod electrodes wherein an annular ion guiding region is formed between the inner and outer rod electrodes and FIG. 6B shows an end-on view of the inner and outer arrangements of rod electrodes.
Figure 6B:
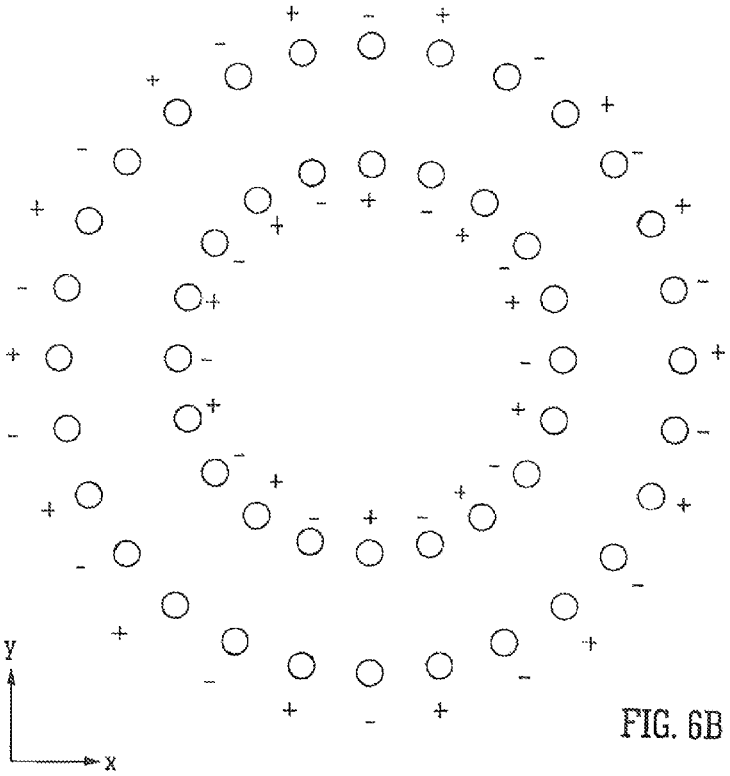

According to another embodiment, the preferred ion guide or ion trap may be constructed from rod electrodes which are preferably arranged in the axial (z) direction as shown in FIG. 6A. As shown in FIG. 6B, an inner ring or cylindrical arrangement of rod electrodes may be provided wherein alternate phases of a RF voltage are preferably applied to adjacent or alternate rod electrodes of the inner ring of electrodes.

Similarly, a larger outer ring or cylindrical arrangement of rod electrodes may be provided which preferably surrounds the inner ring of rod electrodes. The outer ring or cylindrical arrangement of rod electrodes may comprise a greater number of rod electrodes than the inner ring or cylindrical arrangement of rod electrodes. In the particular embodiment shown in FIG. 6B the inner ring of rod electrodes comprises 20 rod electrodes and the outer ring of rod electrodes comprises 28 rod electrodes. Alternating phases of the RF voltage are preferably applied to adjacent rods or alternate rod electrodes of the outer ring of rod electrodes.

The inner ring of rod electrodes and the outer ring of rod electrodes are preferably positioned relative to one another so that ions are free to travel fully around the circumference of the annular ion guiding region. Ions are not prevented from moving and are not confined in a tangential direction which is orthogonal to both the radial direction and the axial length of the ion guide or ion trap.

Embodiments are contemplated wherein different patterns of RF voltages may be applied to the electrodes.

For example, the following table shows three different configurations A, B, C of confining RF voltage which may be applied to a stacked ring or other axially segmented ion guide comprising inner electrodes and outer electrodes:

| | PLATE | 1 | 2 | 3 | 4 | 5 |
|---|---|---|---|---|---|---|
| Configuration A | OUTER | + | − | + | − | + |
| | INNER | − | + | − | + | − |
| Configuration B | OUTER | + | − | + | − | + |
| | INNER | + | − | + | − | + |
| Configuration C | OUTER | + | + | − | − | + |
| | INNER | − | + | − | + | − |

With reference to FIG. 4, "OUTER" refers to a lens or other element of the outer cylindrical arrangement of electrodes 4 and "INNER" refers to a lens or other element of the inner cylindrical arrangement of electrodes 5. The row labeled "PLATE" refers to the position of the lens or other element in the axial (z) direction from the inlet of the device and "+" and "−" refer to the phase of the applied RF voltage.

Configuration A corresponds with the arrangement shown in FIG. 4. This configuration of applied RF voltages results in a broad steep sided pseudo-potential well which has similarities to a pseudo-potential well of a conventional stacked ring ion guide.

Configuration B results in a series of conjoined toroidal pseudo potential ion traps. The aspect ratio of the individual electrodes is preferably arranged so as to allow a substantially quadratic pseudo-potential field to be developed. Mass selective ejection may be accomplished from any of these toroidal traps by mass selective instability and or application of dipolar or quadrupolar AC excitation potential to one or more of the electrodes or electrode pairs. Mass selective ejection may be either in a radial or axial direction depending on how the potential is applied.

More complex combinations of RF voltage may be applied to the plate electrodes such as in the manner of configuration C as detailed above.

The RF phase and or amplitude can be switched to allow switching between different operational modes and different configurations.

The preferred ion guide or ion trap may be combined with a fragmentation device such as a CID or SID cell which may be arranged upstream or downstream of the preferred ion guide or ion trap.

The preferred ion guide or ion trap may be combined with additional separation devices such as an IMS device, a mass spectrometer, an ion trap Time of Flight analyser or a quadrupole arranged upstream or downstream of the preferred ion guide or ion trap.

Although the present invention has been described with reference to preferred embodiments, it will be understood by those skilled in the art that various changes in form and detail may be made without departing from the scope of the invention as set forth in the accompanying claims.

The invention claimed is:

1. An ion guide or ion trap comprising:

a first group of inner electrodes;

a second group of outer electrodes;

an annular ion guiding region arranged between said first and second groups of electrodes; and a RF voltage device arranged and adapted to apply a RF voltage to said first and second groups of electrodes so that ions are confined within said annular ion guiding region by a first radial RF or pseudo-potential barrier and by a second different radial RF or pseudo-potential barrier;

wherein ions are substantially unconfined or unrestrained in a tangential direction which is orthogonal both to a radial direction and to a longitudinal axis of said ion guide or ion trap; and wherein in use one or more transient DC voltages or one or more transient DC voltage waveforms are applied to said first group of inner electrodes or to said second group of outer electrodes or to one or more additional electrodes so that ions are caused to move along the longitudinal axis from one end of said ion guide or ion trap to another end of said ion guide or ion trap.

2. An ion guide or ion trap as claimed in claim 1, wherein said first radial RF or pseudo-potential barrier acts to prevent ions moving in a radially inward direction towards said inner electrodes.

3. An ion guide or ion trap as claimed in claim 1, wherein said second radial RF or pseudo-potential barrier acts to prevent ions moving in a radially outward direction towards said outer electrodes.

4. An ion guide or ion trap as claimed in claim 1, wherein:

(a) ions within said annular ion guiding region are free to rotate or orbit around a full circumference of said annular ion guiding region; or (b) ions are unconfined or unrestrained by DC potentials or RF pseudo-potentials in a tangential direction which is orthogonal both to a radial direction and to the longitudinal axis of said ion guide or ion trap; or (c) ions are substantially free to occupy an entire annular area of said annular ion guiding region.

5. An ion guide or ion trap as claimed in claim 1, wherein in a mode of operation said RF voltage device is arranged and adapted to apply different or opposite phases of said RF voltage to inner and outer electrodes which are arranged: (i) at substantially the same axial displacement; or (ii) in substantially the same plane; or (iii) substantially opposite each other in a radial direction.

6. An ion guide or ion trap as claimed in claim 1, wherein in a mode of operation said RF voltage device is arranged and adapted to apply the same phase of said RF voltage to inner and outer electrodes which are arranged either: (i) at substantially the same axial displacement; or (ii) in substantially the same plane; or (iii) substantially opposite each other in a radial direction.

7. An ion guide or ion trap as claimed in claim 1, wherein said RF voltage device is arranged and adapted to apply different or opposite phases of said RF voltage to alternate or axially adjacent inner or outer electrodes or alternate or axially adjacent sub-groupings of inner or outer electrodes.

8. An ion guide or ion trap as claimed in claim 7, wherein said sub-groupings of said inner or outer electrodes comprise at least 2, 3, 4, 5, 6, 7, 8, 9 or 10 electrodes.

9. An ion guide or ion trap as claimed in claim 7, wherein electrodes in each sub-grouping of electrodes are maintained at substantially the same DC potential or at substantially the same phase of said RF voltage.

10. An ion guide or ion trap as claimed in claim 1, wherein:

(a) said RF voltage has a frequency selected from the group consisting of: (i)<100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-

8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz; or (b) said RF voltage has an amplitude selected from the group consisting of: (i)<50 V peak to peak; (ii) 50-100 V peak to peak; (iii) 100-150 V peak to peak; (iv) 150-200 V peak to peak; (v) 200-300 V peak to peak; (vi) 300-400 V peak to peak; (vii) 400-500 V peak to peak; (viii) 500-600 V peak to peak; (ix) 600-700 V peak to peak; (x) 700-800 V peak to peak; (xi) 800-900 V peak to peak; (xii) 900-1000 V peak to peak; (xiii) 1000-1100 V peak to peak; (xiv) 1100-1200 V peak to peak; (xv) 1200-1300 V peak to peak; (xvi) 1300-1400 V peak to peak; (xvii) 1400-1500 V peak to peak; and (xviii) >1500 V peak to peak.

11. An ion guide or ion trap as claimed in claim 1, wherein:

(i) inner and outer electrodes arranged at substantially the same axial displacement are maintained at substantially the same DC potential; or (ii) positive or negative ions within said annular ion guiding region are not substantially attracted in a radial direction to either said inner electrodes or to said outer electrodes.

12. An ion guide or ion trap as claimed in claim 1, wherein said outer electrodes or said inner electrodes comprise:

(i) one or more planar or sheet electrodes; or (ii) one or more axially segmented cylindrical arrangement of electrodes; or (iii) one or more axially segmented circular cylindrical arrangement of electrodes; or (iv) a stacked ring ion guide.

13. An ion guide or ion trap as claimed in claim 1, wherein said outer electrodes comprise one or more substantially circular, elliptical or polygonally shaped apertures.

14. An ion guide or ion trap as claimed in claim 1, wherein said inner electrodes are substantially circular, elliptical or polygonally shaped.

15. An ion guide or ion trap as claimed in claim 1, wherein said outer electrodes or said inner electrodes comprise one or more rod electrodes.

16. An ion guide or ion trap as claimed in claim 15, wherein said one or more rod electrodes have a substantially circular or hyperbolic cross-section.

17. An ion guide or ion trap as claimed in claim 1, wherein either:

(a) said second group of outer electrodes comprises a lesser or greater number of electrodes than said first group of inner electrodes; or (b) said second group of outer electrodes comprises the same number of electrodes as said first group of inner electrodes.

18. An ion guide or ion trap as claimed in claim 1, wherein a cross-sectional area of said annular ion guiding region between said inner and outer electrodes is selected from the group comprising: (i) 5-10 $mm^2$; (ii) 10-20 $mm^2$; (iii) 20-30 $mm^2$; (iv) 30-40 $mm^2$; (v) 30-40 $mm^2$; (vi) 40-50 $mm^2$; (vii) 50-60 $mm^2$; (viii) 60-70 $mm^2$; (ix) 70-80 $mm^2$; (x) 80-90 $mm^2$; (xi) 90-100 $mm^2$; and (xii) >100 $mm^2$.

19. An ion guide or ion trap as claimed in claim 1, wherein said first group of inner electrodes are substantially concentric with said second group of outer electrodes.

20. An ion guide or ion trap as claimed in claim 1, wherein either: (i) said first group of inner electrodes are arranged at substantially the same axial spacing as said second group of outer electrodes; or (ii) said first group of inner electrodes are arranged at a substantially different, greater or lesser axial spacing than said second group of outer electrodes.

21. An ion guide or ion trap as claimed in claim 1, wherein in a mode of operation said ion guide or ion trap is maintained at a pressure selected from the group consisting of: (i)<$1\times10^{-7}$ mbar; (ii) $1\times10^{-7}$ to $1\times10^{-6}$ mbar; (iii) $1\times10^{-6}$ to $1\times10^{-5}$ mbar; (iv) $1\times10^{-5}$ to $1\times10^{-4}$ mbar; (v) $1\times10^{-4}$ to $1\times10^{-3}$ mbar; (vi) 0.001-0.01 mbar; (vii) 0.01-0.1 mbar; (viii) 0.1-1 mbar; (ix) 1-10 mbar; (x) 10-100 mbar; (xi) 100-1000 mbar; or (xii) >1000 mbar.

22. An ion guide or ion trap as claimed in claim 1, further comprising a device arranged and adapted to introduce a buffer gas into said annular ion guiding region in order to collisionally cool ions.

23. An ion guide or ion trap as claimed in claim 1, further comprising a device arranged and adapted to apply an electrostatic driving force to at least some of said first group of inner electrodes or to at least some of said second group of outer electrodes in order to urge ions along at least a portion of an axial length of said ion guide or ion trap.

24. An ion guide or ion trap as claimed in claim 1, wherein, in use, an axial DC potential gradient is maintained along at least a portion of an axial length of said ion guide or ion trap.

25. An ion guide or ion trap as claimed in claim 24, wherein said axial DC potential gradient either: (i) is maintained substantially constant with time as ions pass along said ion guide or ion trap; or (ii) varies with time as ions pass along said ion guide or ion trap.

26. An ion guide or ion trap as claimed in claim 1, further comprising a DC voltage device arranged and adapted to apply a DC voltage to said first group of electrodes or said to second group of electrodes or to one or more additional electrodes in order to maintain a quadratic or other potential well along at least a portion of an axial length of said ion guide or ion trap.

27. An ion guide or ion trap as claimed in claim 1, further comprising a device which is arranged and adapted to resonantly, parametrically or auto-resonantly eject ions or to eject ions due to mass selective instability in a radial or axial direction from said ion guide or ion trap.

28. An ion guide or ion trap as claimed in claim 1, wherein ions are mass selectively or mass to charge ratio selectively ejected from said ion guide or ion trap in a radial or axial direction from said ion guide or ion trap.

29. An ion guide or ion trap as claimed in claim 27, wherein ions are mass or mass to charge ratio selectively ejected from said ion guide or ion trap in order of their mass to charge ratio or in reverse order of their mass to charge ratio.

30. An ion guide or ion trap as claimed in claim 1, wherein ions are caused to separate according to their ion mobility or mass or mass to charge ratio along an axial length of said ion guide or ion trap.

31. An ion guide or ion trap as claimed in claim 1, wherein said annular ion guiding region either: (i) varies in size or shape along a length of said ion guide or ion trap; or (ii) has a width or height or diameter or cross-sectional area which varies, increases or decreases along a longitudinal length of said ion guide or ion trap.

32. An ion guide or ion trap as claimed in claim 1, wherein said ion guide or ion trap comprises a linear, non-linear, curved, open-loop or closed-loop ion guide or ion trap.

33. An ion guide or ion trap as claimed in claim 1, further comprising an entrance electrode arranged upstream of said ion guide or ion trap or an exit electrode arranged downstream of said ion guide.

34. An ion guide or ion trap as claimed in claim 33, wherein one or more DC or AC or RF voltages are applied to said entrance electrode or said exit electrode in order to confine ions axially within said ion guide or ion trap.

35. A mass spectrometer comprising an ion guide or ion trap as claimed in claim 1.

36. A method of guiding ions conducted with a first group of inner electrodes, a second group of outer electrodes and an annular ion guiding region arranged between said first and second groups of electrodes, said method comprising:

applying a RF voltage to said first and second groups of electrodes so that ions are confined within said annular ion guiding region by a first radial RF or pseudo-potential barrier and by a second different radial RF or pseudo-potential barrier, wherein ions are substantially unconfined or unrestrained in a tangential direction which is orthogonal both to a radial direction and to a longitudinal axis of said ion guide or ion trap; and applying one or more transient DC voltages or one or more transient DC voltage waveforms to said first group of inner electrodes or to said second group of outer electrodes or to one or more additional electrodes so that ions are caused to move along the longitudinal axis from one end of said ion guide or ion trap to another end of said ion guide or ion trap.

37. A method of mass spectrometry comprising a method of guiding ions as claimed in claim 36.

38. An ion guide or ion trap as claimed in claim 1 wherein the radial length of the first group of inner electrodes is larger than the radial length of the annular ion guiding region between the inner and outer electrodes.

39. The method according to claim 36 wherein the radial length of the first group of inner electrodes is larger than the radial length of the annular ion guiding region between the inner and outer electrodes.

* * * * *